US008157257B2

(12) United States Patent
Toyooka et al.

(10) Patent No.: US 8,157,257 B2
(45) Date of Patent: Apr. 17, 2012

(54) SHEET FEEDING DEVICE AND ELECTROPHOTOGRAPHIC IMAGE FORMING APPARATUS WITH ROTATING CHARGED BELT

(75) Inventors: Tsugunao Toyooka, Sagamihara (JP); Manabu Nonaka, Chigasaki (JP); Toshifumi Togashi, Zama (JP); Hideto Higaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/801,050

(22) Filed: May 19, 2010

(65) Prior Publication Data

US 2010/0296851 A1 Nov. 25, 2010

(30) Foreign Application Priority Data

May 20, 2009 (JP) ..... 2009-121551

(51) Int. Cl.
*B65H 3/16* (2006.01)

(52) U.S. Cl. ..... 271/18.1; 271/18.2

(58) Field of Classification Search ..... 271/18.1, 271/18.2

See application file for complete search history.

(56) References Cited

U.S. PATENT DOCUMENTS

| | | | | |
|---|---|---|---|---|
| 4,925,177 | A * | 5/1990 | Nakamura et al. | 271/110 |
| 5,219,154 | A * | 6/1993 | Fukube et al. | 271/18.2 |
| 5,971,389 | A * | 10/1999 | Golicz et al. | 271/34 |
| 6,824,131 | B2 | 11/2004 | Togashi | |
| 6,948,710 | B2 | 9/2005 | Togashi et al. | |
| 7,418,235 | B2 | 8/2008 | Nonaka et al. | |
| 7,515,866 | B2 | 4/2009 | Togashi et al. | |
| 7,611,138 | B2 | 11/2009 | Fujita et al. | |
| 7,635,123 | B2 | 12/2009 | Wantanabe et al. | |
| 7,673,984 | B2 | 3/2010 | Nonaka | |
| 2002/0036377 | A1 | 3/2002 | Togashi | |
| 2003/0155702 | A1 | 8/2003 | Togashi et al. | |
| 2005/0253323 | A1 | 11/2005 | Fujita et al. | |
| 2007/0127090 | A1 | 6/2007 | Nonaka | |
| 2008/0006995 | A1 | 1/2008 | Nonaka | |
| 2010/0032891 | A1 * | 2/2010 | Togashi et al. | 271/18.1 |

FOREIGN PATENT DOCUMENTS

| | | |
|---|---|---|
| JP | 3865277 | 10/2006 |
| JP | 2009-023813 | 2/2009 |

OTHER PUBLICATIONS

Abstract of Japan Publication No. JP 2003-0237958 published on Aug. 27, 2003.

* cited by examiner

*Primary Examiner* — Gerald McClain

(74) *Attorney, Agent, or Firm* — Harness, Dickey & Pierce, P.L.C.

(57) ABSTRACT

A sheet feeding device incorporable in an image forming apparatus includes a sheet holder to hold a stack of sheets including an uppermost sheet, an endless belt, a charging member, a belt supporting unit including a drive roller and a driven roller, a moving mechanism to move the sheet holder, and a controller. The controller alternately controls the moving mechanism to move the sheet holder to a proximal position, the endless belt to contact the uppermost sheet held on the sheet holder, and the driven roller to rotate about the drive roller, to attract the uppermost sheet, and controls the moving mechanism to move the sheet holder to a distal position, the driven roller to rotate about the drive roller, and the endless belt to incline at a predetermined angle of separation, to separate the uppermost sheet from the multiple sheets.

8 Claims, 8 Drawing Sheets

SHEET FEEDING DEVICE AND ELECTROPHOTOGRAPHIC IMAGE FORMING APPARATUS WITH ROTATING CHARGED BELT

CROSS-REFERENCE TO RELATED APPLICATIONS

The present patent application claims priority pursuant to 35 U.S.C. §119 from Japanese Patent Application No. 2009-121551, filed on May 20, 2009 in the Japan Patent Office, which is hereby incorporated by reference herein in its entirety.

BACKGROUND OF THE INVENTION

1. Field of the Invention

Exemplary embodiments of the present patent application relate to a sheet feeding device and an electrophotographic image forming apparatus incorporating the sheet feeding device, and more particularly, to a sheet feeding device that electrostatically attracts a sheet of a recording medium to an endless belt member for separating and feeding the sheet therefrom, and an electrophotographic image forming apparatus incorporating the sheet feeding device.

2. Discussion of the Related Art

Related-art image forming apparatuses, such as electrophotographic copiers, facsimile machines, printers, or multifunction printers having at least one of copying, printing, scanning, and facsimile functions, typically form an image on a sheet of recording media according to image data. Thus, for example, a sheet feeding device loads a plurality of sheets and feeds the plurality of sheets one by one toward an image forming device. The image forming device forms an image on a sheet supplied from the sheet feeding device.

As one approach, an electrostatic sheet feed method to separate and feed a sheet electrostatically has been proposed.

The electrostatic sheet feed method is employed in a sheet feeding device that can be incorporated in an electrostatic image forming apparatus. The sheet feeding device includes an endless dielectric belt member and a charging member for charging and discharging the surface of the endless dielectric belt.

The endless dielectric belt member that rotates in a sheet feed direction contacts a top surface of a stack of sheets, and the charging member applies alternating charges (that is, electrical charges of alternating polarity) to the surface of the endless dielectric belt member. The charging member performs both a charging operation to form an alternating charge pattern on the surface of the endless dielectric belt member and a discharging operation to discharge or remove the charge from the surface of the endless dielectric belt member. Application of electric charge to the endless dielectric belt member to contact the endless dielectric belt member to the sheet increases the electric potential of the sheet and causes oppositely polarized electric charges to generate a force of attraction. This action can separate an uppermost sheet from the stack of sheets and feed the uppermost sheet in a sheet conveyance direction.

As another example of an electrostatic sheet feed method, JP 2003-237958 discloses a sheet feeding device that includes a belt unit including an endless belt and a charging roller. The endless belt is looped over a drive roller and a driven roller to rotate according to rotation of the drive roller. The charging roller applies an electric charge to an outer surface of the endless belt. The belt unit is driven by a swing motor.

In the sheet feeding device as disclosed in JP 2003-237958, when the charging roller forms an alternating charge pattern on the outer surface of the endless belt, the swing motor drives the belt unit to move from a home position of the belt unit to a position close to the uppermost sheet along an axial direction of the drive roller. Thus, the endless belt contacts the uppermost sheet placed on top of the stack of sheets and attracts the uppermost sheet.

After a given period of time has elapsed to separate the uppermost sheet from the stack of sheets with the endless belt attracting the uppermost sheet, the swing motor moves the belt unit back to the home position. Thus, the uppermost sheet separates from the other sheets of the stack of sheets.

As another approach, JP 2009-023813 discloses a different electrostatic sheet feeding device. The electrostatic sheet feeding device disclosed in JP 2009-023813 includes a sheet stacker that accommodates multiple sheets, a sheet feeding roller that contacts a top surface of the multiple sheets accommodated in the sheet stacker and feeds an uppermost sheet placed on the multiple sheets in a sheet feeding direction, a separation pad, an electrostatic sheet attraction unit disposed upstream from the position of the sheet feeding roller in the sheet feeding direction that electrostatically attracts the uppermost sheet, and a driving unit to swing the electrostatic sheet attraction unit in a substantially vertical direction.

The electrostatic sheet attraction unit includes two rollers and an electrostatic attraction belt that is looped over the two rollers. A charging roller is disposed in a vicinity of the electrostatic attraction belt to apply an alternating voltage to the electrostatic attraction belt to electrostatically charge the electrostatic attraction belt.

The driving unit includes a drive shaft that is disposed opposite the sheet feeding roller with the sheet stacker interposed therebetween and a supporting arm that is pivotably supported by the drive shaft. The electrostatic sheet attraction unit moves in a substantially vertical direction about the drive shaft via the supporting arm.

In the sheet feeding device as disclosed in JP 2009-023813, the driving unit swings the electrostatic sheet attraction unit downward to contact the uppermost sheet of the stack of sheets. With this action, the electrostatic attraction belt that is charged by the charging roller attracts the uppermost sheet. As the supporting arm moves in an upward direction, the electrostatic sheet attraction unit is elevated to a predetermined level of height to separate the uppermost sheet attracted by the electrostatic attraction belt from the stack of sheets.

However, to achieve the above-described operation, the sheet feeding device disclosed in JP 2003-237958 requires the swing motor to swing the belt unit between the home position and a position close to the uppermost sheet when performing an attracting operation and a separating operation. Use of such a swing motor complicates construction and increases the cost of the sheet feeding device.

The sheet feeding device as disclosed in JP 2009-023813 requires the driving unit including the supporting arm to swing the electrostatic sheet attraction unit in a substantially vertical direction when attracting and separating the sheet. As a result, similar to JP 2003-237958, installation of the driving unit complicates construction and increases the cost of the sheet feeding device.

SUMMARY OF THE INVENTION

Example aspects of the present patent application have been made in view of the above-described circumstances, and provide a sheet feeding device that can separate an uppermost sheet from a stack of sheets to feed the uppermost sheet in a sheet feeding direction without complicating construction of the sheet feeding device and increasing the cost of the sheet feeding device.

Other example aspects of the present patent application provide an image forming apparatus that can include the above-described sheet feeding, device.

In one exemplary embodiment, a sheet feeding device includes a sheet holder, an endless belt, a charging member, a belt supporting unit, a moving mechanism, and a controller. The sheet holder holds multiple sheets thereon, and the multiple sheets include an uppermost sheet placed on top thereof. The endless belt of multilayer construction includes an outer layer formed of a dielectric material, and attracts the uppermost sheet to separate the uppermost sheet from the multiple sheets and feed the uppermost sheet in a sheet conveyance direction. The charging member charges the outer layer of the endless belt with an alternating voltage. The belt supporting unit includes a drive roller having a drive roller shaft and looped over the endless belt to rotate the endless belt and a driven roller having a driven roller shaft and looped over the endless belt to rotate with the drive roller. The moving mechanism is movable between a proximal position where the sheet holder approaches the endless belt and a distal position where the sheet holder moves away from the endless belt. The controller controls an operation performed by the moving mechanism. The controller controls the moving mechanism to move the sheet holder to the proximal position, the endless belt to contact the uppermost sheet held on the sheet holder, and the driven roller to rotate about the drive roller, so as to attract the uppermost sheet. Further, the controller controls the moving mechanism to move the sheet holder to the distal position, the driven roller to rotate about the drive roller, and the endless belt to incline at a predetermined angle of separation, so as to separate the uppermost sheet from the multiple sheets.

The belt supporting unit may include a supporting member, one end of which rotatably supports the drive roller shaft and the other end of which rotatably supports the driven roller shaft at a predetermined distance between the ends. The supporting member allows the driven roller to rotate about the drive roller shaft with movement of the sheet holder.

The belt supporting unit may further include a biasing member to bias the driven roller toward a direction in which the drive roller stays away from the driven roller.

The belt supporting unit may adjust an angle of inclination of the endless belt with respect to the stack of sheets to separate the uppermost sheet from the stack of sheets held on the sheet holder.

The angle of inclination may be determined according to an amount of movement of the sheet holder by the moving mechanism.

The above-described sheet feeding device may further include a detector to detect a position of the driven roller. The belt supporting unit may rotate the endless belt according to a detection result obtained by the detector indicating that the driven roller is detected at a predetermined position.

In one exemplary embodiment, an image forming apparatus includes the above-described sheet feeding device and an image forming device to form an image on a sheet fed by the sheet feeding device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
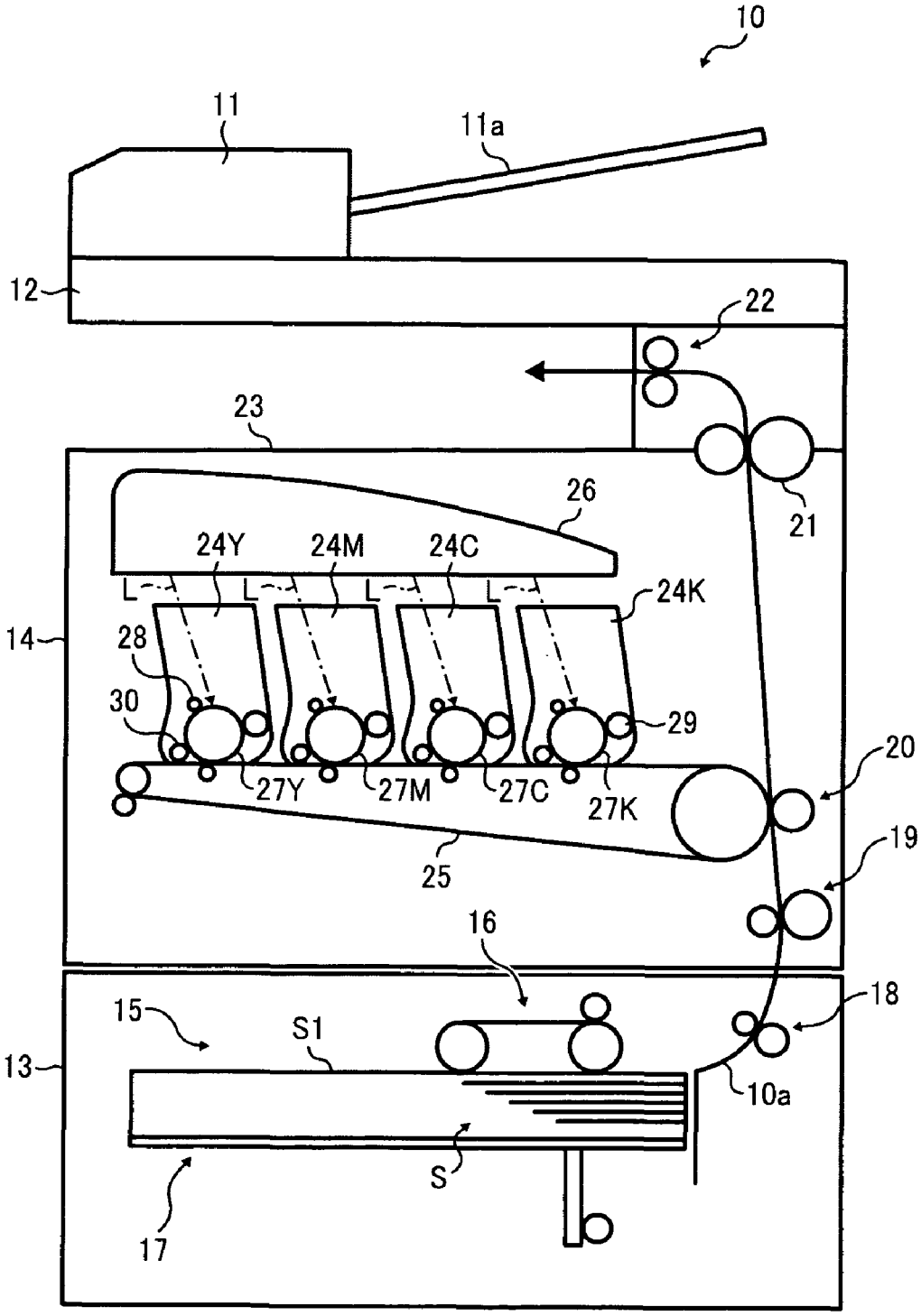
FIG. 1 is a schematic view of an image forming apparatus including a sheet feeding device, according to an example embodiment of the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

FIGS. 1 through 9 are drawings of an electrophotographic image forming apparatus 10 according to an example embodiment of the present patent application, and a sheet feeding device 15 according to an example embodiment of the present patent application.

FIG. 1 is a schematic view of the image forming apparatus 10.

As illustrated in FIG. 1, the image forming apparatus 10 includes an automatic document feeder (ADF) 11, a document reader 12, a sheet supplying device 13, an image forming device 14, a pair of conveyance rollers 18, a pair of registration rollers 19, a fixing unit 21, a pair of sheet discharging rollers 22, and a sheet discharging tray 23.

As illustrated in FIG. 1, the image forming apparatus 10 may be a copier, a facsimile machine, a printer, a multifunction printer having at least one of copying, printing, scanning, plotter, and facsimile functions, or the like. The image forming apparatus 1 may form an image by an electrophotographic method, an inkjet method, and/or the like. According to this example embodiment, the image forming apparatus 1 functions as a copier for forming an image on a recording medium by the electrophotographic method.

The ADF 11 is mounted on the document reader 12. The ADF 11 includes a document sheet tray 11*a* to hold a stack of sheets thereon. The ADF 11 separates each sheet one by one from the stack of sheets on the document sheet tray 11*a* to automatically feed the separated sheet to the document reader 12.

The document reader 12 reads image data of the sheet fed from the ADF 11 on a contact glass mounted thereon.

The sheet supplying device 13 is disposed below the image forming device 14. The sheet supplying device 13 accommodates a stack of sheets S or recording media therein to supply an uppermost sheet S1 separated from the stack of sheets to the image forming device 14.

The image forming device 14 forms an image on the uppermost sheet S1 supplied by the sheet supplying device 13 according to the image data read in the document reader 12.

According to this example embodiment, the image forming device 14 can separate from the sheet supplying device 13 for supplying the uppermost sheet S to the image forming device 14.

The sheet supplying device 13 includes a sheet feeding device 15. The sheet feeding device 15 contacts the uppermost sheet S1 atop the stack of sheets loaded in a sheet carrier 17, described below, that carries the stack of sheets S therein, attracts the uppermost sheet S1, and separates the uppermost sheet S1 from the stack of sheets S.

The uppermost sheet S1 separated by the sheet feeding device 15 travels in a conveyance path 10*a* that passes through a nip formed between the pair of conveyance rollers 18, a nip formed between the pair of registration rollers 19, and a secondary transfer nip formed between the transfer roller 20 and a roller facing the transfer roller 20 with an intermediate transfer belt 25 interposed therebetween.

Through the conveyance path 10*a*, the uppermost sheet S1 is conveyed forward by the pair of conveyance rollers 18 and the pair of registration rollers 19, and receives a toner image formed in the image forming device 14 at the secondary transfer nip of the transfer roller 20. The toner image is then fixed to the uppermost sheet S1 in the fixing unit 21 by application of heat and pressure, and is finally discharged to the sheet discharging tray 23 by the pair of sheet discharging rollers 22.

The image forming device 14 includes four image forming units 24 (specifically, an image forming unit 24Y for forming yellow toner image, an image forming unit 24C for forming cyan toner image, an image forming unit 24M for forming magenta toner image, and an image forming unit 24K for forming black toner image), the intermediate transfer belt 25 that serves as a transfer belt, and an optical writing device 26.

The optical writing device 26 receives color separation image data transmitted from an external device such as a personal computer or a word processor and image data of original documents read by the document reader 12 and converts the image data to a signal for light source driving. Accordingly, the optical writing device 26 drives a semiconductor laser in each laser light source unit and emits light beams L.

The image forming units 24Y, 24C, 24M, and 24K form respective single-color toner images different from each other. The image forming units 24Y, 24C, 24M, and 24K include a photoconductor 27 (specifically, a photoconductor 27Y for carrying yellow toner image thereon, a photoconductor 27C for carrying cyan toner image thereon, a photoconductor 27M for carrying magenta toner image thereon, and a photoconductor 27K for carrying black toner image thereon), and image forming components disposed around the photoconductor 27. The image forming components included in each of the image forming units 24Y, 24C, 24M, and 24K shown in FIG. 1 are a charging unit 28, a developing unit 29, and a cleaning unit 30.

The photoconductor 27 is a cylindrical image carrier that is rotated by a drive source, not illustrated, in a clockwise direction in FIG. 1. The photoconductor 27 has a photoconductive layer as an outer surface thereof. The light beams L or light spots emitted by the optical writing device 26 irradiate the outer surface of the photoconductor 27 to optically write an electrostatic latent image according to image data.

The charging unit 28 is disposed contacting the photoconductor 27 to uniformly charge the outer surface of the photoconductor 27.

The developing unit 29 supplies toner to the outer surface of the photoconductor 27 to develop the electrostatic latent image into a visible toner image. In this example embodiment, a non-contact type developing unit that does not directly contact the photoconductor 27 is employed.

The cleaning unit 30 is a brush-contact-type unit in which a brush member thereof is disposed slidably contacting the outer surface of the photoconductor 27 to remove residual toner remaining on the outer surface of the photoconductor 27.

The intermediate transfer belt 25 is an endless belt member including a resin film or a rubber material. The toner image is transferred from the photoconductor 27 onto a surface of the intermediate transfer belt 25 before being further transferred onto the uppermost sheet S1 at the secondary transfer nip formed by the transfer roller 20.

Figure 2:
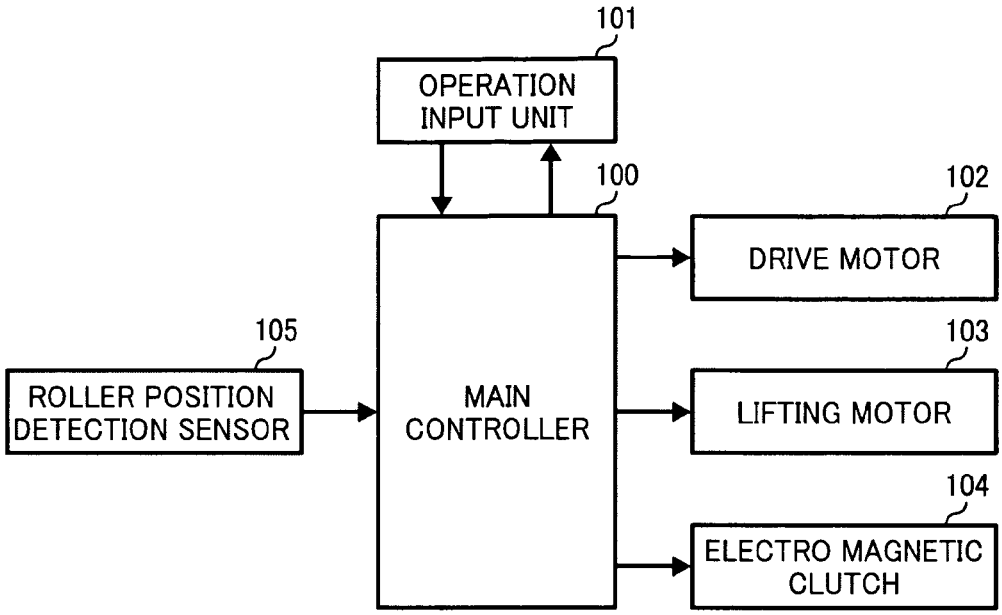
FIG. 2 is a block diagram illustrating a configuration of a control unit of the image forming apparatus shown in FIG. 1.

FIG. 2 is a block diagram illustrating a configuration of a control unit 100 provided to the image forming apparatus 10 according to an example embodiment of the present patent application.

As illustrated in FIG. 2, the control unit 100 is formed of a microcomputer that includes a central processing unit (CPU), a read-only memory (ROM), a random access memory (RAM), an input and output (I/O) interface, and the like.

The control unit 100 shown in FIG. 2 is connected to an operation input unit 101, a drive motor 102, a lifting motor 103, an electromagnetic clutch 104, a roller position detection sensor 105, and other various sensors and motors provided to the image forming apparatus 10.

The control unit 100 controls operations of the drive motor 102, the lifting motor 103, and the electromagnetic clutch 104 according to signals inputted from the operation input unit 101, the roller position detection sensor 105 and so forth, thereby causing the sheet feeding device 15 to perform a sheet feeding operation and a sheet conveyance operation.

The operation input unit 101 is provided in the image forming apparatus 10 and includes various keypads such as a numeric keypad and a print start keypad, and various indicators. A user inputs sheet information such as material and size of a sheet directly or selects the sheet information via selection buttons through the operation input unit 101 when feeding the sheet by the sheet feeding device 15. The sheet information inputted or selected by the user is converted to a signal and is outputted to the control unit 100.

The drive motor 102 rotates a drive roller 40 included in the sheet supplying device 13 according to the input signal from the control unit 100. The details of the drive roller 40 will be described below.

The lifting motor 103 rotates a pinion 62 included in the sheet carrier 17, described below, according to the input signal from the control unit 100.

The electromagnetic clutch 104 is disposed between the drive motor 102 and the drive roller 40 and switches between opening (transmission) and closing (blocking) the power source between the drive motor 102 and the drive roller 40 according to the input signal from the control unit 100.

The roller position detection sensor 105 detects a position of a driven roller 41 included in a sheet separation feeder 16, which will be described later, and outputs a signal according to the detection results to the control unit 100. Specifically, the roller position detection sensor 105 detects whether the driven roller 41 is located at a home position, a sheet attraction position, or a sheet separation position. The image forming apparatus 10 may preferably include two or more roller position detection sensors 105 to detect a corresponding position of the home position, the sheet attraction position, and the sheet separation position.

Next, a description is given of the sheet feeding device 15 according to an example embodiment of the present patent application.

As described above, the sheet feeding device 15 includes the sheet separation feeder 16 and the sheet carrier 17.

Figure 3:
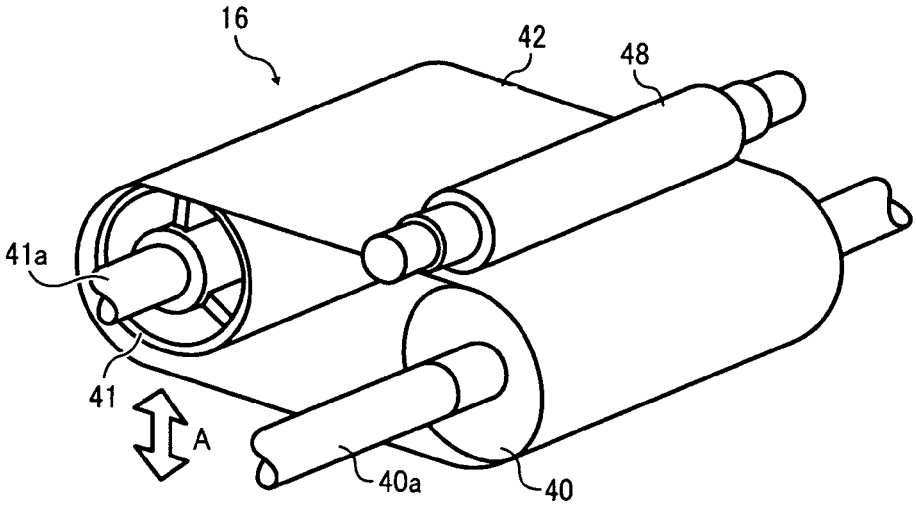
FIG. 3 is a perspective view of a sheet separation feeder, according to an example embodiment of the preset patent application, provided in the sheet feeding device of FIG. 1.

FIG. 3 illustrates a perspective view of the sheet separation feeder 16.

As illustrated in FIG. 3, the sheet separation feeder 16 includes the drive roller 40, the driven roller 41, an endless belt 42, and a charging roller 48. The endless belt 42 includes a dielectric looped over the drive roller 41 that drives the endless belt 42 and the driven roller 41 that is rotated with the drive roller 40. A width, that is, a direction along an axial direction of the sheet separation feeder 16 is narrower or smaller than that of the uppermost sheet S1 and is disposed in the vicinity of the latitudinal center in the width direction of the uppermost sheet S1. Alternatively the width of the sheet separation feeder 16 can be equal to or greater than that of the uppermost sheet S1. Further, two or more sheet separation feeders 16 can be disposed along the width of the uppermost sheet S1 while one sheet separation feeder 16 is provided in the vicinity of the latitudinal center in the width of the uppermost sheet S1 in the sheet supplying device 13 in FIG. 1.

The charging roller 48 that serves as a charging member extends along the width of the endless belt 42. Details of the charging roller 48 will be described below.

The drive roller 40 includes a drive roller shaft 40*a* that is rotatably supported by a housing of the image forming apparatus 10 of FIG. 1. The drive roller 40 is driven by the driving force exerted by the drive motor 102, as illustrated in FIG. 2, to rotate the endless belt 42.

An outer surface of the drive roller 40 includes a conductive rubber layer having a resistivity of about $10^6\Omega\cdot$cm. An inner part of the conductive rubber layer of the drive roller 40 includes a rubber material having a resistivity of about $10^6\Omega\cdot$cm. Both the surface and the inner part of the driven roller 41 include metal. The driven roller 41 rotates with rotation of the endless belt 42 that is driven by the drive roller 40.

The driven roller 41 includes a driven roller shaft 41*a*. Unlike the drive roller shaft 40*a* of the drive roller 40, the driven roller shaft 41*a* of the driven roller 41 is not supported by the housing of the image forming apparatus 10 of FIG. 1. The driven roller shaft 41*a* can rotate or swing about the drive roller shaft 40*a* in a substantially vertical direction indicated by double-headed arrow "A" shown in FIG. 3.

The driven roller 41 is lowered in a direction closer to the uppermost sheet S1 placed on top of the stack of sheets S on the sheet carrier 17 by its own weight. Consequently, the driven roller 41 is rotated in the direction A along with the movement of as the sheet carrier 17 having the stack of sheets S thereon. That is, as the sheet carrier 17 moves up and down (as indicated by arrow "B" in FIGS. 5A and 5B), the relative position of the driven roller 41 to the drive roller 40 may change between the home position as shown in FIG. 5A, the sheet attraction position as shown in FIG. 5B, and the sheet separation position as shown in FIG. 5C, details of which will be described later.

Figure 5A:
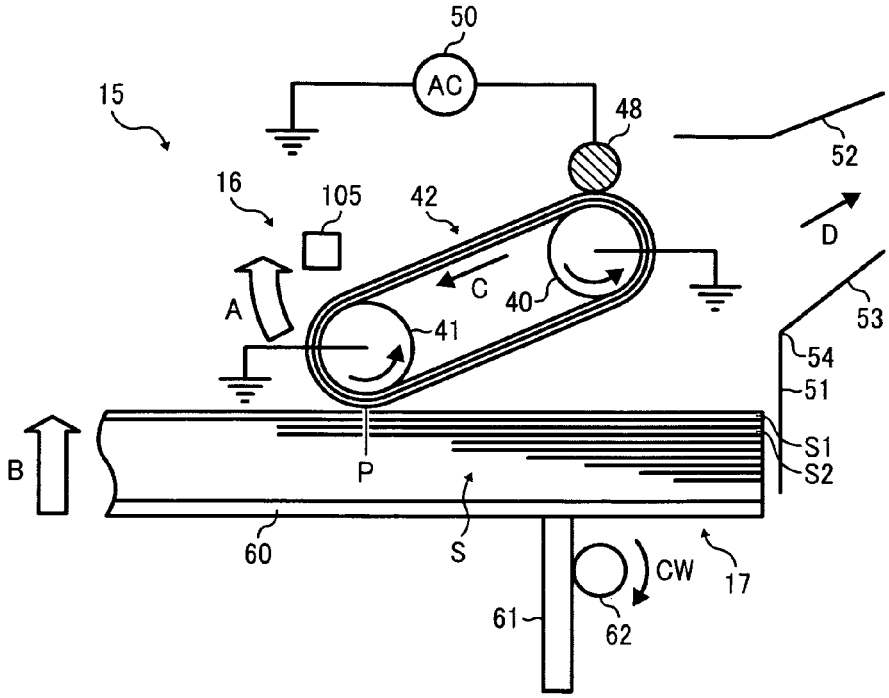
FIG. 5A is a side view of the sheet feeding device shown in FIG. 1, at a home position, according to an example embodiment of the present patent application.

The home position is defined as a position of the driven roller 41, as illustrated in FIG. 5A, at which the line connecting or across the axis of the drive roller 40 and the axis of the driven roller 41 is inclined with respect to the uppermost sheet S1 on the sheet carrier 17 at a predetermined angle and at which the surface of the endless belt 42 nearly contacts the surface of the uppermost sheet S1 with a predetermined gap at a point P where the endless belt 42 is looped over the driven roller 41.

Figure 5B:
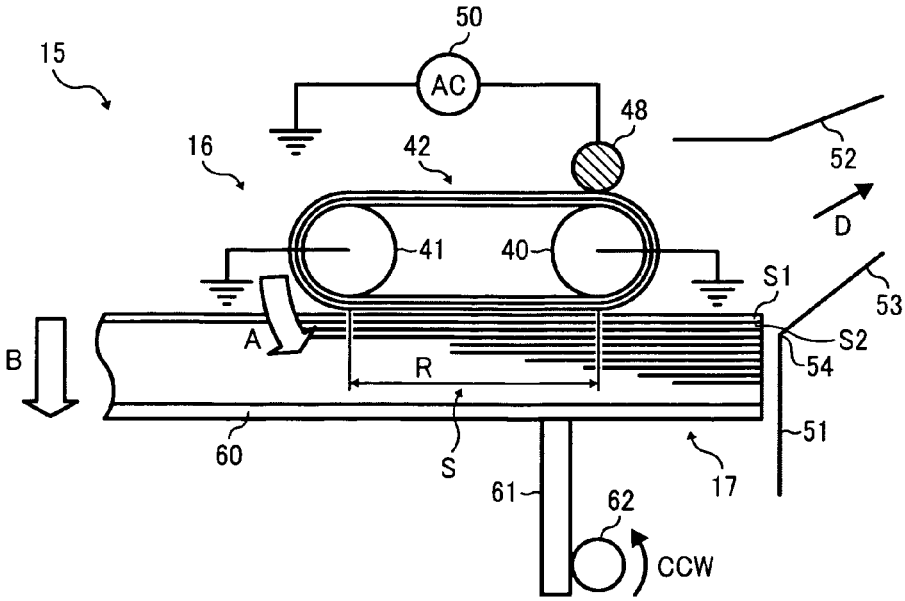
FIG. 5B is a side view of the sheet feeding device shown in FIG. 1, at a sheet attraction position for attracting a sheet placed on top of a stack of sheets, according to an example embodiment of the present patent application.

The sheet attraction position is defined as a position of the driven roller 41, as illustrated in FIG. 5B, at which a line connecting or across an axis of the drive roller 40 and an axis of the driven roller 41 is parallel to the uppermost sheet S1 of the stack of sheets S loaded on the sheet carrier 17 and at which the surface of the endless belt 42 contacts the uppermost sheet S1 in a predetermined range R.

Figure 5C:
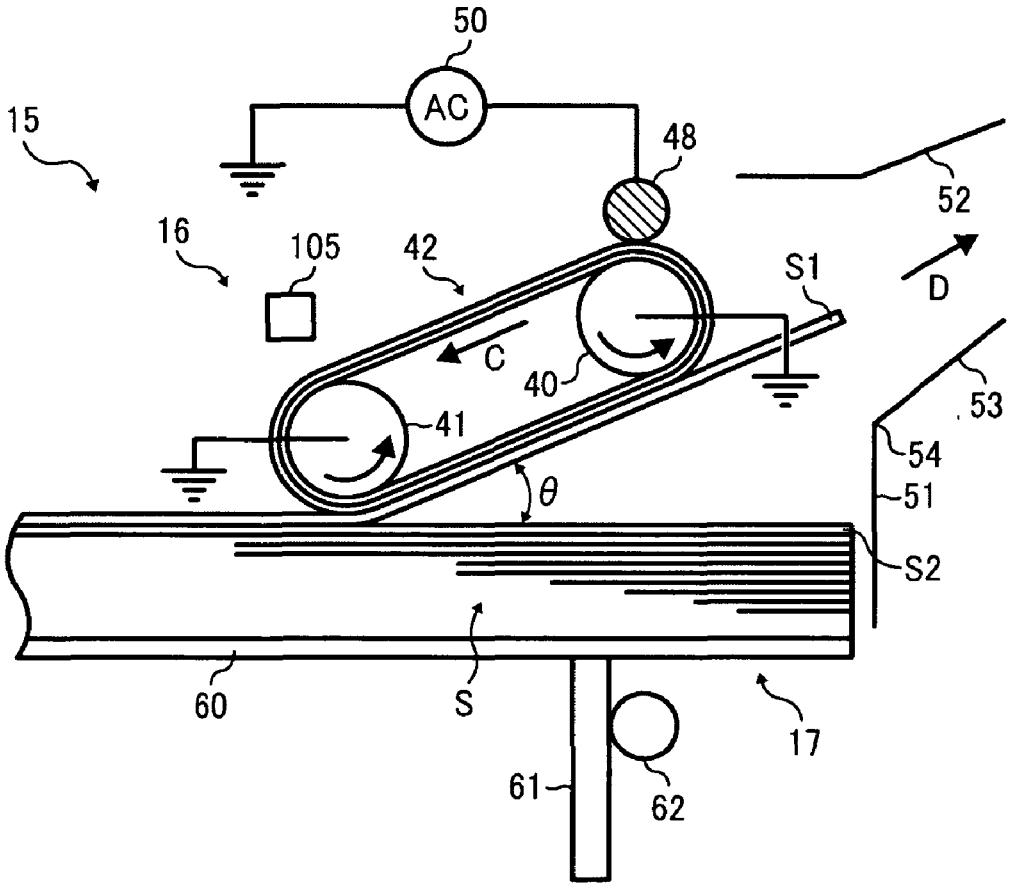
FIG. 5C is a side view of the sheet feeding device shown in FIG. 1, at a sheet separation position for turning over and separating the sheet from the stack of sheets, according to an example embodiment of the present patent application.

The sheet separation position is defined as a position of the driven roller 41, as illustrated in FIG. 5C, at which the line connecting or across the axis of the drive roller 40 and the axis of the driven roller 41 is in angled contact with the uppermost sheet S1 on the sheet carrier 17 at an angle of inclination θ for separating the uppermost sheet S1. The angle of inclination θ may also be referred to an angle of separation θ.

It is to be noted that the drive roller 30 and the driven roller 31 are electrically grounded.

Figure 4A:
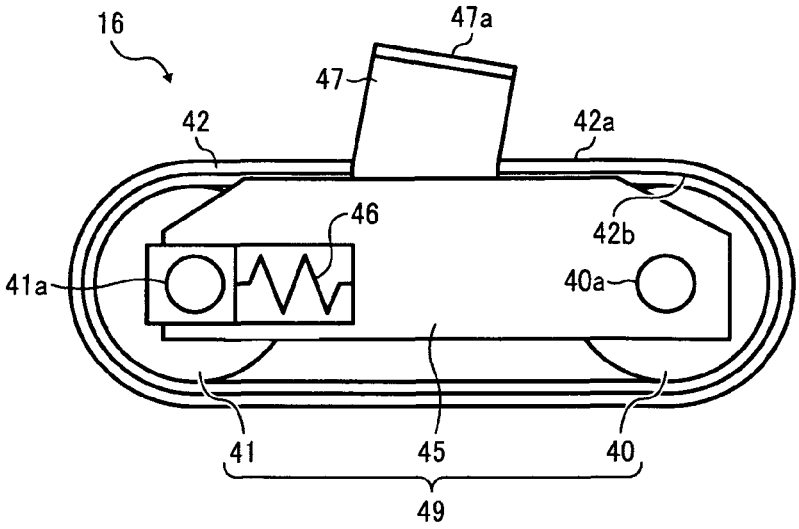
FIG. 4A is a side view of a part of the sheet separation feeder shown in FIG. 3, according to an example embodiment of the present patent application.
Figure 4B:
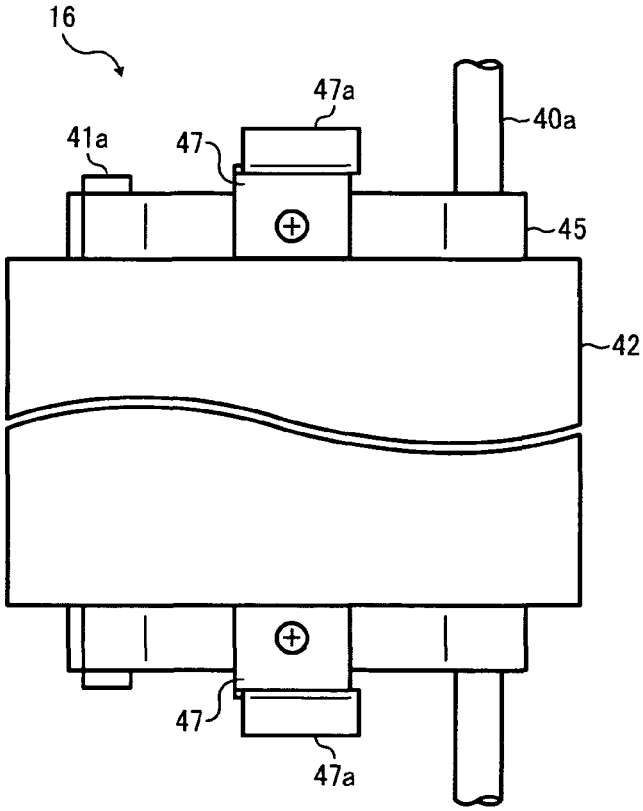
FIG. 4B is a top view of the part of the separation feeder shown in FIG. 4A, according to an example embodiment of the present patent application.

FIG. 4A is a side view of a part of the sheet separation feeder 16 and FIG. 4B is a top view of the sheet separation feeder 16 of FIG. 4A.

As illustrated in FIGS. 4A and 4B, the drive roller shaft 40*a* of the drive roller 40 and the driven roller shaft 41*a* of the driven roller 41*a* are rotatably supported by supporting members 45, each of which is disposed at opposite ends of both shafts 40*a* and 41*a*. For simplicity, only the supporting members 45 are illustrated in FIGS. 4A and 4B even though the supporting members 45 are provided to support the shafts 40*a* and 41*a*.

As shown in FIG. 4A, the supporting members 45 are provided to regulate a distance between the drive roller 40 and the driven roller 41. A spring 46 is disposed at each end of the driven roller shaft 41*a* of the driven roller 41 to serve as a biasing member to urge the driven roller shaft 41*a* in a direction away from the drive roller shaft 40*a*. Consequently, the endless belt 42 that is looped over the drive roller 40 and the driven roller 41 can remain tensioned properly by the biasing force of the spring 46.

One end of each supporting member 45 rotatably supports the drive roller shaft 40*a* and the other end rotatably supports the driven roller shaft 41*a*. The driven roller shaft 41*a* is rotatably supported only by the supporting members 45. Consequently, the supporting members 45 support the driven roller 41 to rotate about the drive roller shaft 40*a*.

The drive roller 40, the driven roller 41, and the supporting members 45 form a belt supporting unit 49 as shown in FIG. 4A.

A stopper 47 is provided at an upper part of a center of each of the supporting members 45 in a longitudinal direction of the supporting members 45. Each of the stoppers 47 has a projection portion 47*a* having a slope inclining with respect to the endless belt 42 at a predetermined angle of inclination and projecting outwardly.

When the endless belt 42 tilts at the home position shown in FIG. 5A, the stopper 47 contacts a positioning member, not illustrated, which is attached to the housing. By so doing, the drive roller shaft 40*a* can be positioned where the projecting portion 47*a* becomes level or horizontal, thereby regulating the movement of the driven roller 41 to descend under its own weight. Consequently, the stopper 47 can nearly contact the surface of the endless belt 42 with the surface of the uppermost sheet S1 with a predetermined gap at the home position. In an example embodiment, the angle of inclination of the endless belt 42 at this time can be the maximum angle of inclination. The projecting portion 47*a* may contact a regulating portion formed on the housing of the image forming apparatus 10, for example.

For applying electric charge to the endless belt 42, the endless belt 42 should be rotated in a belt rotation direction indicated by arrow "C" in FIGS. 5A and 5C. If the endless belt 42 contacts the stack of sheets S while the endless belt 42 is rotating, the uppermost sheet S1 is likely to be fed when the electric charge is applied to the endless belt 42. To address this, in this example embodiment, the stopper 47 can provide a predetermined gap between the surface of the endless belt 42 and the surface of the uppermost sheet S1. With this configuration, the endless belt 42 does not contact the uppermost sheet S1 at the home position as shown in FIG. 5A, thereby preventing the uppermost sheet S1 from being fed in a sheet feeding direction indicated by arrow "D" in FIGS. 5A through 5C.

As illustrated in FIG. 4A, the endless belt 42 is looped over the drive roller 40 and the driven roller 41 and is rotated in the belt rotation direction C following the rotation of the drive roller 40 between the drive roller 40 and the driven roller 41. The endless belt 42 includes a dielectric having a resistivity not smaller than about $10^8$Ω·cm. For example, the dielectric of the endless belt 42 may be a polyethylene terephthalate film having a thickness of about 100 μm.

The endless belt 42 has a multilayer construction that includes a front layer 42*a* (see FIG. 4A) having a resistivity of about $10^8$Ω·cm or greater and/or a back layer 42*b* (see FIG. 4B) having a resistivity of about $10^6$Ω·cm or smaller to maintain a good charging state. The stack of sheets S is disposed at a position at which the uppermost sheet S1 is attracted by the endless belt 42 at a sufficient area.

As previously noted, the charging roller 48 serving as a charging member extends along the width direction of the endless belt 42 and contacts the endless belt 42 at a point where the endless roller 42 is looped over the drive roller 40.

The charging roller 48 is a charging electrode connected to a charging power source 50 for generating an alternating current. The charging power source 50 applies an alternating voltage to the endless belt 42 as needed. The charging roller 48 uses the back layer 42*b* of the endless belt 42 as a grounded opposing electrode. Therefore, the charging roller 48 may contact the front layer 42*a* of the endless belt 42 at any position on the front layer 42*a* of the endless belt 42. Instead of the charging roller 48, this example embodiment can employ a charging blade as a charging electrode to apply electric charge to the endless belt 42.

Instead of the alternating current, the charging power source 50 may apply a direct current in which high and low potentials are alternately provided. According to this example embodiment, the charging power source 50 applies an alternating current having amplitude of about 4 KV to the surface of the endless belt 42, as shown in FIG. 5A.

The charging power source 50 depicted in FIG. 5A applies an alternating voltage via the charging roller 48 to the endless belt 42 rotated by the driving roller 40. As shown in FIG. 5A, the applied alternating voltage is discharged to form a charge pattern in which pitches preferably in a range from about 5 mm to about 15 mm are alternately provided on the front layer 42*a* of the endless belt 42 according to a frequency of the charging power source 50 for generating the alternating current and a rotation speed (e.g., a circumferential speed) of the endless belt 42.

As illustrated in FIGS. 5A through 5C, the sheet carrier 17 includes a bottom plate 60, a rack 61, and the pinion 62. The bottom plate 60 serves as a sheet holder to hold the stack of sheets S thereon. The bottom plate 60 moves up and down in FIGS. 5A and 5B with the stack of sheets S loaded thereon.

The bottom plate 60 is disposed interposing between the bottom surface of a sheet cassette, not illustrated, and the stack of sheets S. The rack 61 is mounted on the back side or lower side of the bottom plate 60 and engaged with the pinion 62 that is driven to rotate by the lifting motor 103 (refer to FIG. 2). With this structure, the lifting motor 103 drives the rack 61 and the pinion 62 to move the bottom plate 60 upwardly in the vertical direction B in FIG. 5A while maintaining the bottom plate 60 parallel. Namely, the bottom plate 60 can be moved in the vertical direction B between a remote or distal position where the driven roller 41 comes to the home position and the sheet separation position and a close or proximal position where the driven roller 41 comes to the sheet attraction position.

In this example embodiment, the lifting motor 103, the rack 61, and the pinion 62 form a moving mechanism to move the bottom plate 60 to approach or separate from the endless belt 42 with the stack of sheets S interposed therebetween.

The bottom plate 60 can be attached to the sheet cassette provided to the sheet feeding device 15 of the image forming apparatus 10 via the rack 61 by slidably engaging the rack 61 to a cylindrical portion that projects from the bottom plate 60 or by slidably engaging both ends of the bottom plate 60 in the width direction thereof with a side plate disposed on both ends of the sheet cassette in the width direction thereof. The lifting motor 103 that drives to rotate the pinion 62 can interpose between the bottom plate 60 and the bottom surface of the sheet cassette.

The operation of the lifting motor 103 is controlled by the control unit 100 of the image forming apparatus 10, as illustrated in FIG. 2. That is, the control unit 100 controls the operation of the lifting motor 103 to adjust the amount of movement of the bottom plate 60 in the vertical direction B.

Further, the roller position detection sensor 105, which is also connected to the control unit 100 illustrated in FIG. 2, is disposed in proximity to and along an axial direction of the driven roller 41. As previously described, two or more roller position detection sensors 105 are preferably provided to detect a corresponding position of the home position, the sheet attraction position, and the sheet separation position.

The sheet feeding device 15 further includes a side wall 51, an upper guide plate 52, a lower guide plate 53, and a connecting point 54, as illustrated in FIGS. 5A through 5C.

The side wall 51, the upper guide plate 52, and the lower guide plate 53 are provided at a downstream side from the endless belt 42 in the sheet feeding direction D, which is on the right side of FIGS. 5A through 5C. The side wall 51 regulates the leading edge of sheets in the stack of sheets S carried on the sheet carrier 17. The upper guide plate 52 and the lower guide plate 53 define a part of the conveyance path 10*a* (refer to FIG. 1) to regulate conveyance of the sheets.

A point of intersection, i.e., the connecting point 54 of the side wall 51 and the lower guide plate 53 is located higher than the position of the uppermost sheet S1 of the stack of sheets S at the home position (FIG. 5A) and the sheet separation position (FIG. 5C).

Figure 6:
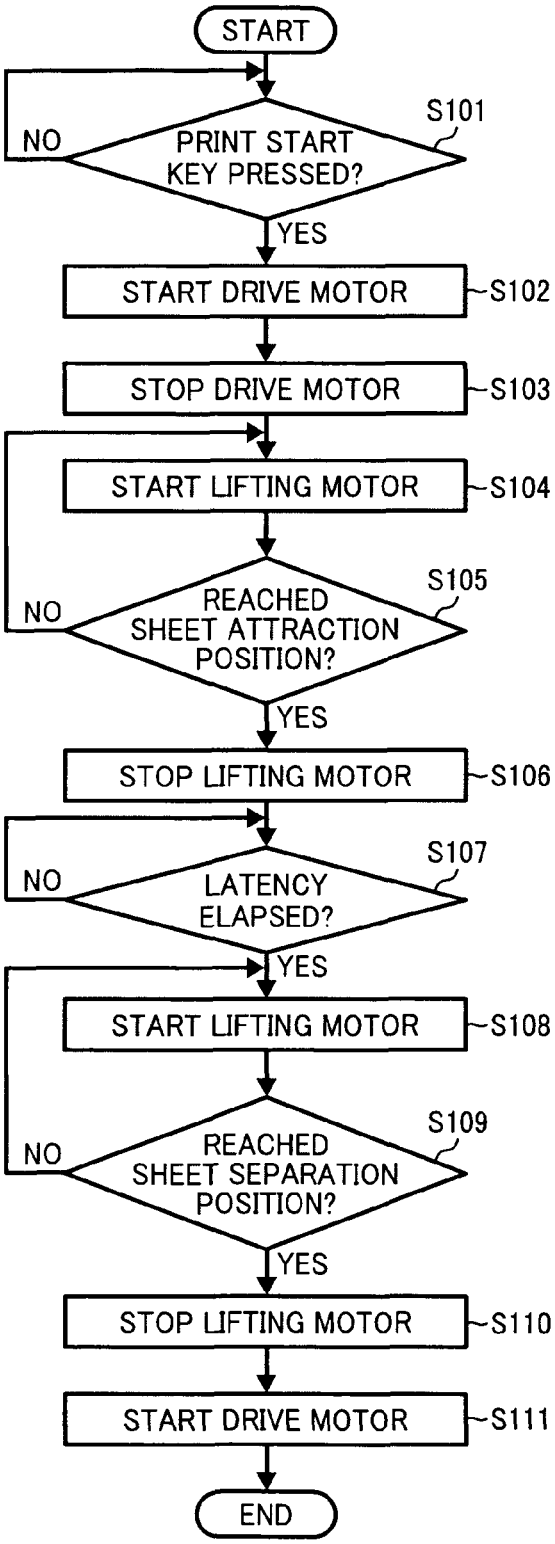
FIG. 6 is a flowchart of a control procedure of a sheet feeding operation performed in the sheet feeding device of FIG. 1, according to an example embodiment of the present patent application.
Figure 7:
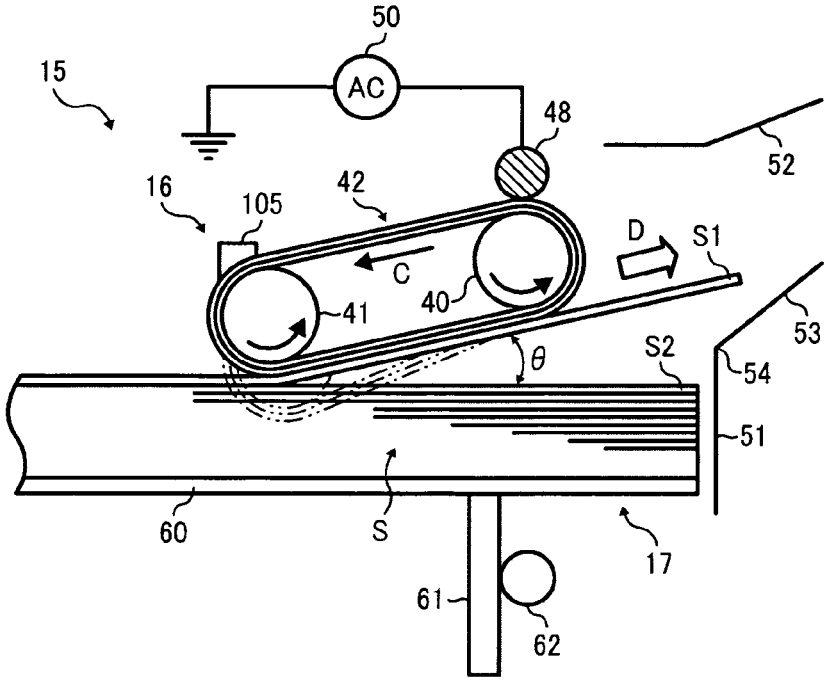
FIG. 7 is a side view of the sheet feeding device shown in FIG. 1, in a step of the sheet feeding operation according to an example embodiment of the present patent application.

FIG. 6 is a flowchart showing steps in a control procedure of a sheet feeding operation performed in the sheet feeding device 15 by the control unit 100. A description is given of the control procedure illustrated in the flowchart, with reference to FIGS. 5A through 9.

As described in the flowchart of FIG. 6, the control unit 100 determines in step S101 whether or not a user has pressed any key on the print start keypad provided on the operation input unit 101.

When the control unit 100 determines that the user has not pressed any key on the print start keypad, the detection result is "NO" and the process repeats the procedure in step S101 until a user presses any key on the print start keypad.

When the control unit 100 determines that the user has pressed the key on the print start keypad, the detection result is "YES" and the process moves to step S102.

In step S102, the control unit 100 transmits a sheet feeding signal to turn on the electromagnetic clutch 104 and drive the drive motor 102. According to the start of the drive motor 102, the drive roller 40 in the sheet feeding device 15 rotates. Accordingly, the endless belt 42 starts to rotate between the drive roller 40 and the driven roller 41 and the charging power source 50 applies the alternating voltage to the endless belt 42 via the charging roller 48. At this time, the charge pattern having a pitch determined by the frequency of the charging power source 50 and the rotation speed (e.g., the circumferential speed) of the endless belt 42 is alternately provided on the front layer 42*a* of the endless belt 42. Namely, the endless belt 42 is charged with the alternating voltage.

At completion of charging the endless belt 42 in step S102, the control unit 100 stops the drive motor 102 rotating the endless belt 42 in step S103.

Then, in step S104, the control unit 100 rotates the lifting motor 103 in a clockwise (CW) direction. The rotation of the lifting motor 103 rotates the pinion 62 in the sheet feeding device 15 in the clockwise (CW) direction in FIG. 5A. In the sheet feeding device 15, the bottom plate 60 moves up via the rack 61 to attract the uppermost sheet S1 to separate from the stack of sheets S carried on the sheet carrier 17. As the bottom plate 60 elevates, the endless belt 42 contacts the uppermost sheet S1 at the point P and the driven roller 41 is rotated about the drive roller 40 upwardly in the direction A in FIG. 5A.

After step S104, the control unit 100 determines whether or not the driven roller 41 has reached the sheet attraction position (refer to FIG. 5B) in step S105. Specifically, the control unit 100 determines whether or not the driven roller 41 has reached the sheet attraction position by determining whether or not the roller position detection sensor 105 provided near the sheet attraction position has detected the driven roller 41.

When the control unit 100 determines that the driven roller 41 has not yet reached the sheet attraction position, the detection result is "NO" and the control unit 100 rotates the lifting motor 103 to repeat the procedure in step S104 until the driven roller 41 reaches the sheet attraction position.

When the control unit 100 determines that the driven roller 41 has reached the sheet attraction position, the detection result is "YES" and the process proceeds to step S106.

In step S106, the control unit 100 stops the rotation of the lifting motor 103. Accordingly, the bottom plate 60 in the sheet feeding device 15 stops further ascent. At this time, in the sheet feeding device 15 as shown in FIG. 5B, the endless belt 42 formed with the positive and negative charge patterns alternatively on the front layer 42*a* contacts the front side (e.g., the upper side) of the uppermost sheet S1 at the predetermined range R. A non-uniform electric field formed by the positive and negative charge patterns on the front layer 42*a* of the endless belt 42 applies the Maxwell stress to the dielectric, uppermost sheet S1. Accordingly, the uppermost sheet S1 is attracted to the endless belt 42, and is held and conveyed by the endless belt 42.

Then, the control unit 100 determines whether or not a predetermined latency has elapsed, in step S107.

Generally, the force of attraction exerted due to the charge pattern with respect to sheets affects on the uppermost sheet S1 and any subsequent sheets in the stack of sheets S for a predetermined period of time from the moment the endless belt 42 contacts the stack of sheets S. After the predetermined period of time elapsed, the force of attraction only affects on the uppermost sheet S1 and does not affect any subsequent sheets in the stack of sheets S. Therefore, the uppermost sheet S1 has been separated from any subsequent sheets including a subsequent sheet S2 by waiting for the predetermined latency. However, this sheet separation and feed method requires a constant latency after the uppermost sheet S1 is attracted by the endless belt 42, and therefore may degrade productivity of sheet feeding.

To address this drawback, this example embodiment employs a sheet turning operation, described below, to turn the uppermost sheet S1 off to separate from the subsequent sheet S2 in the stack of sheets S, so as to decrease the above-described latency to enhance productivity of sheet feeding.

When the control unit 100 determines that the predetermined latency has not yet elapsed, the detection result of step S107 is "NO" and the control unit 100 repeats the procedure in step S107 until the predetermined latency elapses.

When the control unit 100 determines that the predetermined latency has elapsed, the detection result of step S107 is "YES", and the process goes to step S108.

In step S108, the control unit 100 causes the lifting motor 103 to rotate in a counterclockwise (CCW) direction.

As shown in FIG. 5B, the pinion 62 in the sheet feeding device 15 rotates in the counterclockwise (CCW) direction, which lowers the bottom plate 60. Then, as illustrated in FIG. 5C, the bottom plate 60 in the sheet feeding device 15 moves down via the rack 61 to separate the uppermost sheet S1 from the subsequent sheet S2, as illustrated in FIG. 5C. As the bottom plate 60 moves downwardly in the direction B, the driven roller 41 rotates about the drive roller shaft 40*a* downwardly in the direction A by its own weight.

Then, the control unit 100 determines in step S109 whether or not the driven roller 41 has reached the sheet separation position. Specifically, the control unit 100 determines whether or not the driven roller 41 has reached the sheet separation position by determining whether or not the roller position detection sensor 105 provided near the sheet separation position has detected the driven roller 41.

When the control unit 100 determines that the driven roller 41 has not yet reached the sheet separation position, the detection result is "NO" and the control unit 100 rotates the lifting motor 103 to repeat the procedure in step S108 until the driven roller 41 reaches the sheet separation position.

When the control unit 100 determines that the driven roller 41 has reached the sheet separation position, the detection result is "YES" and the process proceeds to step S110.

In step S110, the control unit 100 stops the rotation of the lifting motor 103. Accordingly, the bottom plate 60 in the sheet feeding device 15 stops further ascent.

At this time, in the sheet feeding device 15 as shown in FIG. 5C, the endless belt 42 tilts with respect to the stack of sheets S at the predetermined angle of inclination θ, with the uppermost sheet S1 attracted to the endless belt 42. The angle of inclination θ is an appropriate angle that varies depending on the material of each sheet of the stack of sheets S including the uppermost sheet S1, described below.

Since the subsequent sheet S2 of the stack of sheets S held on the bottom plate 60 is susceptible to multiple sheet feed together with the uppermost sheet S1, the sheet turning operation is performed to separate the uppermost sheet S1 from the subsequent sheet S2 using the rigidity or resilience of the sheets themselves.

Then, the control unit 100 drives the drive motor 102 in step S111. At this time, as the angle of the endless belt 42 with respect to the stack of sheets S reaches the predetermined angle of separation θ in the sheet feeding device 15, with the separated uppermost sheet S1 attracted to the endless belt 42, the drive motor 102 drives the drive roller 40 to rotate the endless belt 42 in the belt rotation direction C in FIG. 7. Thus, the uppermost sheet S1 attracted to the endless belt 42 is conveyed in the sheet feeding direction D in FIG. 7, and is then conveyed by the pair of conveyance rollers 18 and the pair of registration rollers 19 through the conveyance path 10*a* formed between the upper guide plate 52 and the lower guide plate 53 to the image forming device 14 shown in FIG. 1.

Sheets separated and fed by the sheet feeding device 15 include different materials and different resilience due to the material of sheets. Therefore, if the angle of separation θ is increased sufficiently when a sheet to be separated has high resilience, the sheet attracted to the endless belt 42 may separate from the endless belt 42 due to the high resilience.

Figure 8:
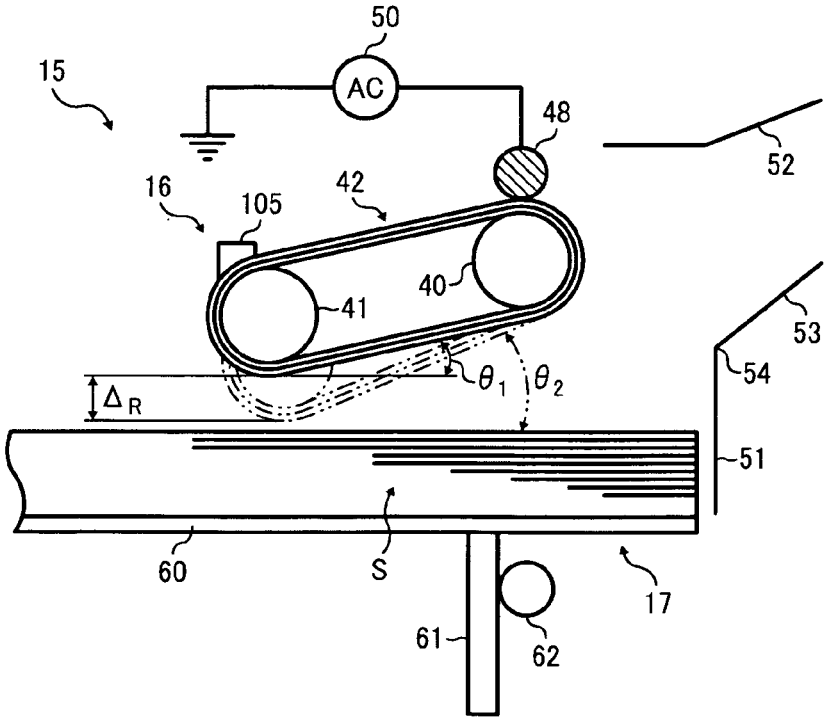
FIG. 8 is a side view of the sheet feeding device shown in FIG. 7, in another step of the sheet feeding operation according to an example embodiment of the present patent application.

In this example embodiment, the angle of separation θ is adjustable according to the resilience of a sheet so that sheets having various types of materials can be separated and fed reliably. The type of material of a sheet to be separated and fed can be selected by user by inputting or selecting keys on the operation input unit 101 (see FIG. 2) provided to the image forming apparatus 10. FIG. 8 illustrates the sheet feeding device 15 for explaining adjustment of the angle of separation θ with the rotation of the driven roller 41.

As illustrated in FIG. 8, the sheet feeding device 15 adjusts the angle of separation θ by changing the amount of descent of the driven roller 41.

For example, to separate and feed a sheet having high resilience to the conveyance path 10*a* defined by the upper guide plate 52 and the lower guide plate 53, the driven roller 41 moves down by a small amount of descent as illustrated by solid lines in FIG. 8 to obtain a small angle of separation θ1. By contrast, to separate and feed a sheet having low resilience to the conveyance path 10*a*, the driven roller 41 moves down by the same amount of descent as above plus an amount of descent ΔR as illustrated by broken lines in FIG. 8 to obtain a large angle of separation θ2.

Figure 9:
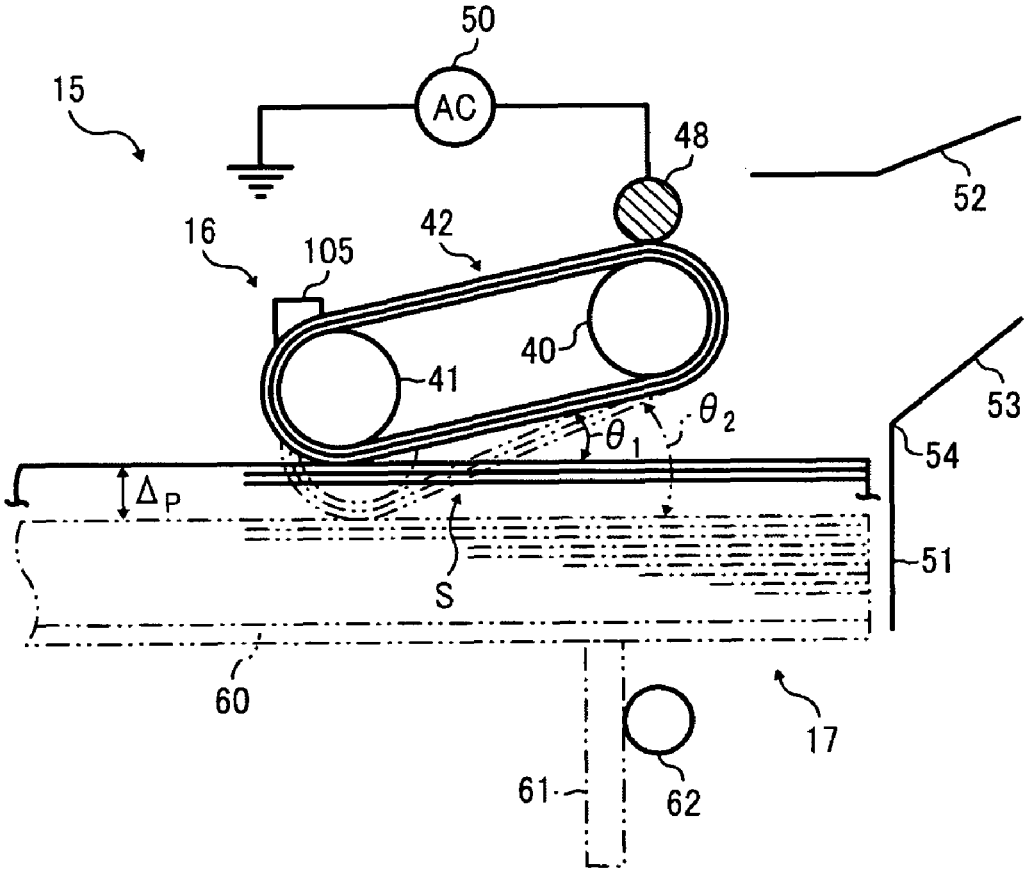
FIG. 9 is a side view of the sheet feeding device shown in FIG. 7, in yet another step of the sheet feeding operation according to an example embodiment of the present patent application.

FIG. 9 illustrates the sheet feeding device 15 for explaining adjustment of the angle of separation θ with the movement of the bottom plate 60.

As illustrated in FIG. 9, the amount of descent of the driven roller 41 is adjusted by an amount of descent of the bottom plate 60.

For example, to separate and feed a sheet having high resilience to the conveyance path 10*a* defined by the upper guide plate 52 and the lower guide plate 53, the bottom plate 60 moves down by a small amount of descent as illustrated by solid lines in FIG. 9 to obtain the small angle of separation θ1. By contrast, to separate and feed a sheet having low resilience to the conveyance path 10*a*, the bottom plate 60 moves down by the same amount of descent as above plus an amount of descent ΔP as illustrated by long dashed double-short dashed lines in FIG. 9 to obtain the large angle of separation θ2.

Accordingly, in this example embodiment, a position of descent of the driven roller 41, i.e., the sheet separation position can be determined and set so as to obtain any optimum angle of separation θ according to types of material of sheets.

Thus, when the roller position detection sensor 105 detects that the driven roller 41 has moved down to the position of descent of the driven roller 41, or the sheet separation position according to the type of material of a sheet, the sheet feeding device 15 performs the sheet turning operation at an optimum angle of separation θ according to resilience of the sheet to separate the uppermost sheet S1 from the stack of sheets S.

As described above, in this example embodiment, the sheet feeding device 15 includes the bottom plate 60 to hold the stack of sheets S that includes the uppermost sheet S1, the endless belt 42, the charging roller 48, the belt supporting unit 49, the moving mechanism that is formed by the lifting motor 103, the rack 61, and the pinion 62, and the control unit 100. The control unit 100 controls the moving mechanism to move the bottom plate 60 to the proximal position to contact the endless belt 42 with the uppermost sheet S1 placed on top of the stack of sheets S held on the bottom plate 60, and the driven roller 41 to rotate about the drive roller 40, to attract the uppermost sheet S1.

Alternately, the control unit 100 controls the moving mechanism to move the bottom plate 60 to the distal position, and the driven roller 41 to rotate about the drive roller 40, and the endless belt 42 to incline at a predetermined angle of separation θ with respect to the non-attracted sheets of the stack of sheets S. At this time, if two or more sheets are attracted to the endless belt 42, the uppermost sheet S1 is separated from the subsequent sheet S2 using the rigidity or resilience of the sheets themselves. Consequently, the attracted uppermost sheet S1 can be separated from the uppermost sheet S1 placed on the stack of sheets S.

Accordingly, the sheet feeding device 15 can move the endless belt 42 and swing the driven roller 42 easily for attracting and separating the uppermost sheet S1 with a simple configuration to move the bottom plate 60 between the proximal position (i.e., the sheet attraction position) and the distal position (i.e., the sheet separating position) in the vertical direction. As a result, the sheet feeding device 15 according to this example embodiment can attract or separate the uppermost sheet S1 easily with the simple configuration, without adding any driving mechanism for moving the endless belt 42 and the driven roller 41.

Further, in this example embodiment, the belt supporting unit 49 of the sheet feeding device 15 includes the supporting member 45 that allows the driven roller 41 to rotate about the drive roller shaft 40*a* according to movement of the bottom plate 60 in the vertical direction. Accordingly, the sheet feeding device 15 can move the endless belt 42 and swing the driven roller 42 easily for attracting and separating the uppermost sheet S1 with a simple configuration to move the bottom plate 60 between the proximal position (i.e., the sheet attraction position) and the distal position (i.e., the sheet separating position) in the vertical direction.

Further, in this example embodiment, the belt supporting unit 49 of the sheet feeding device 15 further includes the spring 46 serving as a biasing member to bias the driven roller 41 toward a direction in which the drive roller 40 stays away from the driven roller 41. Accordingly, the endless belt 42 can remain tensioned properly by the biasing force of the spring 46.

Further, in this example embodiment, the belt supporting unit 49 can adjust an angle of inclination θ of the endless belt 42 with respect to the stack of sheets S, thereby setting the angle of inclination θ, i.e., the angle of separation θ to be an appropriate angle that varies depending on the rigidity or resilience of each sheet of the stack of sheets S including the uppermost sheet S1. Accordingly, the sheets having various types of materials or resilience can be separated and fed reliably in an appropriate manner.

Further, in this example embodiment, the angle of inclination θ is determined according to an amount of movement of the bottom plate 60 by the moving mechanism formed by the lifting motor 103, the rack 61, and the pinion 62. Accordingly, the angle of separation θ can be adjusted with a simple configuration to move the bottom plate 60 in the vertical direction.

Further, in this example embodiment, the sheet feeding device 15 includes the roller position detection sensor 105 serving as a detector to detect the position of the driven roller 41. When the roller position detection sensor 105 detects that the driven roller 41 is moved down to the predetermined lower position, which is the sheet separation position, the drive roller 40 and the driven roller 41 rotate the endless belt 42. Accordingly, when the angle of separation θ becomes equal to the predetermined angle for separating the uppermost sheet S1 from the subsequent sheet S2, only the uppermost sheet S1 to be fed can be fed in the sheet feeding direction reliably.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. A sheet feeding device, comprising:

a sheet holder to hold multiple sheets including an uppermost sheet placed on top thereof;

an endless belt of multilayer construction including an outer layer formed of a dielectric material, the endless belt configured to attract the uppermost sheet to separate the uppermost sheet from the multiple sheets and feed the uppermost sheet in a sheet conveyance direction;

a charging member to charge the outer layer of the endless belt with an alternating voltage;

a belt supporting unit including a drive roller having a drive roller shaft to rotatably support the endless belt and a driven roller having a driven roller shaft to rotatably support the endless belt with the drive roller;

a roller position detection sensor to detect a position of the driven roller and generate output regarding the position of the driven roller;

a moving mechanism movable between a proximal position where the sheet holder approaches the endless belt and a distal position where the sheet holder moves away from the endless belt, the moving mechanism being configured to translate the sheet holder vertically between the proximal position and the distal position; and a controller to control operation of the moving mechanism, the controller configured to alternately control the moving mechanism to move the sheet holder to the proximal position, the endless belt to contact the uppermost sheet held on the sheet holder, and the driven roller to rotate about the drive roller, to attract the uppermost sheet, and control the moving mechanism to move the sheet holder to the distal position, the driven roller to rotate about the drive roller, and the endless belt to incline at an angle of separation, to separate the uppermost sheet from the multiple sheets, the controller being further configured to control the moving mechanism to move the sheet holder, based on the output from the roller position detection sensor, so the endless belt can incline at the angle of separation with respect to non-attracted sheets of the multiple sheets.

2. The sheet feeding device according to claim 1, wherein the belt supporting unit comprises a supporting member, one end of which rotatably supports the drive roller shaft and the other end of which rotatably supports the driven roller shaft at a distance between the ends, the supporting member allowing the driven roller to rotate about the drive roller shaft according to movement of the sheet holder.

3. The sheet feeding device according to claim 2, wherein the belt supporting unit further comprises:

a biasing member to bias the driven roller toward a direction in which the drive roller stays away from the driven roller.

4. The sheet feeding device according to claim 1, wherein the controller is configured to adjust an angle of separation based on a resiliency of the attracted sheet.

5. The sheet feeding device according to claim 4, wherein the controller adjusts an angle of separation by raising or lowering the driven roller.

6. The sheet feeding device according to claim 4, wherein an angle of separation of an attracted sheet having a first resilience is $\theta_1$ and an angle of separation of an attracted sheet having a second resilience is $\theta_2$ and when the first resilience is greater than the second resilience, $\theta_2$ is greater than $\theta_1$.

7. An image forming apparatus, comprising:

the sheet feeding device according to claim 1; and an image forming device to form an image on a sheet fed by the sheet feeding device.

8. The sheet feeding device according to claim 1, wherein the belt supporting unit rotates the endless belt according to a detection result obtained by the roller position detection sensor indicating that the driven roller is detected at a position.

* * * * *